US007458119B2

(12) United States Patent
Hornbach et al.

(10) Patent No.: US 7,458,119 B2
(45) Date of Patent: Dec. 2, 2008

(54) BED HAVING A CHAIR EGRESS POSITION

(75) Inventors: David W. Hornbach, Brookville, IN (US); Virgil J. Niese, Batesville, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 375 days.

(21) Appl. No.: 11/192,897

(22) Filed: Jul. 29, 2005

(65) Prior Publication Data

US 2006/0021144 A1 Feb. 2, 2006

Related U.S. Application Data

(60) Provisional application No. 60/592,540, filed on Jul. 30, 2004.

(51) Int. Cl.
*A61G 7/015* (2006.01)
*A61G 7/053* (2006.01)
*A61G 7/012* (2006.01)

(52) U.S. Cl. ..... 5/618; 5/624; 5/611; 5/600

(58) Field of Classification Search ..... 5/618, 5/624, 600, 613, 616, 617, 611, 11
See application file for complete search history.

(56) References Cited

U.S. PATENT DOCUMENTS

| | | | | | |
|---|---|---|---|---|---|
| 349,089 | A | * | 9/1886 | Gilbert | 5/618 |
| 912,214 | A | * | 2/1909 | Ward | 5/618 |
| 1,055,241 | A | * | 3/1913 | Terry | 5/618 |
| 1,265,257 | A | * | 5/1918 | Schellinger | 5/608 |
| 1,398,203 | A | | 11/1921 | Schmidt | 5/618 |
| 1,973,699 | A | * | 9/1934 | Bradley | 5/618 |
| 2,202,383 | A | * | 5/1940 | Hymer et al. | 5/614 |
| 2,500,742 | A | | 3/1950 | Taylor | 5/616 |
| 3,220,022 | A | | 11/1965 | Nelson | 5/618 |
| 3,402,408 | A | | 9/1968 | Hutt | 5/618 |
| 3,593,350 | A | | 7/1971 | Knight et al. | 5/616 |
| 3,898,702 | A | | 8/1975 | Goodman | 5/618 |
| 4,183,109 | A | * | 1/1980 | Howell | 5/618 |
| 4,639,954 | A | | 2/1987 | Speed | 5/602 |
| 4,680,790 | A | * | 7/1987 | Packard et al. | 379/432 |
| 4,685,159 | A | * | 8/1987 | Oetiker | 5/608 |
| 4,805,249 | A | | 2/1989 | Usman et al. | 5/619 |
| 4,862,529 | A | | 9/1989 | Peck | 5/611 |
| 4,987,620 | A | * | 1/1991 | Sharon | 5/600 |
| 5,454,126 | A | | 10/1995 | Foster et al. | |

(Continued)

FOREIGN PATENT DOCUMENTS

EP 0 405 542 1/1991

(Continued)

OTHER PUBLICATIONS

TotalCare® Bed System Service Manual (man 112rd), pp. 1-11, 1-12, 1-16, 1-17, Nov. 1997.

*Primary Examiner*—Robert G Santos
(74) *Attorney, Agent, or Firm*—Barnes & Thornburg LLP

(57) ABSTRACT

A hospital bed including a frame, head and foot supports, and a deck coupled to the frame. The deck includes a lowerable foot portion disposed between the head and foot supports in a first position and outside the head and foot supports in a second position.

26 Claims, 10 Drawing Sheets

U.S. PATENT DOCUMENTS

| | | | | | |
|---|---|---|---|---|---|
| 5,630,238 | A | * | 5/1997 | Weismiller et al. | 5/600 |
| 5,682,631 | A | * | 11/1997 | Weismiller et al. | 5/618 |
| 5,715,548 | A | * | 2/1998 | Weismiller et al. | 5/624 |
| 5,732,423 | A | * | 3/1998 | Weismiller et al. | 5/425 |
| 5,745,937 | A | * | 5/1998 | Weismiller et al. | 5/624 |
| 5,754,997 | A | * | 5/1998 | Lussi et al. | 5/618 |
| 5,774,914 | A | | 7/1998 | Johnson et al. | 5/602 |
| 5,781,949 | A | * | 7/1998 | Weismiller et al. | 5/715 |
| 5,790,997 | A | | 8/1998 | Ruehl et al. | |
| 5,940,910 | A | * | 8/1999 | Weismiller et al. | 5/600 |
| 6,038,718 | A | * | 3/2000 | Pennington et al. | 5/618 |
| 6,047,424 | A | * | 4/2000 | Osborne et al. | 5/713 |
| 6,119,291 | A | * | 9/2000 | Osborne et al. | 5/600 |
| 6,154,899 | A | * | 12/2000 | Brooke et al. | 5/81.1 R |
| 6,163,903 | A | * | 12/2000 | Weismiller et al. | 5/610 |
| 6,182,310 | B1 | * | 2/2001 | Weismiller et al. | 5/425 |
| 6,185,769 | B1 | * | 2/2001 | Larisey et al. | 5/648 |
| 6,282,738 | B1 | | 9/2001 | Heimbrock et al. | 5/618 |
| 6,324,709 | B1 | * | 12/2001 | Ikeda et al. | 5/185 |
| 6,336,235 | B1 | * | 1/2002 | Ruehl | 5/610 |
| 6,347,420 | B2 | * | 2/2002 | Elliott | 5/618 |
| 6,351,678 | B1 | * | 2/2002 | Borders | 700/83 |
| 6,516,480 | B2 | * | 2/2003 | Elliott | 5/618 |
| 6,584,628 | B1 | * | 7/2003 | Kummer et al. | 5/615 |
| 6,584,629 | B2 | * | 7/2003 | Tsuji et al. | 5/618 |
| 6,684,427 | B2 | * | 2/2004 | Allen et al. | 5/624 |
| 6,691,346 | B2 | | 2/2004 | Osborne et al. | 5/600 |
| 6,694,548 | B2 | | 2/2004 | Foster et al. | 5/600 |
| 6,708,358 | B2 | | 3/2004 | Hensley | 5/915 |
| 7,000,272 | B2 | * | 2/2006 | Allen et al. | 5/624 |
| 7,017,208 | B2 | * | 3/2006 | Weismiller et al. | 5/600 |
| 7,036,166 | B2 | * | 5/2006 | Kramer et al. | 5/618 |
| 7,213,279 | B2 | * | 5/2007 | Weismiller et al. | 5/624 |
| 7,216,384 | B2 | * | 5/2007 | Allen et al. | 5/618 |
| 7,237,287 | B2 | * | 7/2007 | Weismiller et al. | 5/616 |
| 7,325,265 | B2 | * | 2/2008 | Hornbach et al. | 5/618 |
| 7,373,677 | B2 | * | 5/2008 | Barthelt | 5/618 |
| 2001/0029629 | A1 | * | 10/2001 | Tsuji et al. | 5/618 |
| 2002/0174487 | A1 | | 11/2002 | Kramer et al. | 5/618 |
| 2003/0115672 | A1 | * | 6/2003 | Newkirk | 5/600 |
| 2006/0021144 | A1 | * | 2/2006 | Hornbach et al. | 5/618 |
| 2006/0026765 | A1 | * | 2/2006 | Hornbach et al. | 5/618 |
| 2006/0143829 | A1 | * | 7/2006 | Kramer et al. | 5/618 |
| 2007/0294828 | A1 | * | 12/2007 | Hornbach et al. | 5/611 |
| 2008/0052831 | A1 | * | 3/2008 | Weismiller et al. | 5/616 |
| 2008/0127421 | A1 | * | 6/2008 | Hornbach et al. | 5/618 |
| 2008/0148485 | A1 | * | 6/2008 | Barthelt | 5/611 |

FOREIGN PATENT DOCUMENTS

| | | |
|---|---|---|
| FR | 1 079 934 | 12/1954 |
| WO | WO 03 045 193 | 6/2003 |

* cited by examiner

BED HAVING A CHAIR EGRESS POSITION

CROSS-REFERENCE TO RELATED APPLICATIONS

This application claims the benefit of U.S. Provisional Patent Application Ser. No. 60/592,540, filed Jul. 30, 2004, titled "Bed Having a Chair Egress Position", to Hornbach et al., the disclosure of which is expressly incorporated by reference herein.

This application is also related to pending U.S. patent application Ser. No. 10/107,777, published as U.S. 2002/0174487, filed Mar. 27, 2002, U.S. Patent Application Ser. No. 60/591,838, entitled HOSPITAL BED filed Jul. 28, 2004 and corresponding U.S. patent application Ser. No. 11/191,651, filed Jul. 28, 2005; U.S. Patent Application Ser. No. 60/592,642, entitled PATIIENT SUPPORT HAVING POWERED ADJUSTABLE WIDTH, filed Jul. 30, 2004 and corresponding U.S. patent application Ser. No. 11/192,887, filed Jul. 29, 2005; U.S. Patent Application Ser. No. 60/592,775 entitled PATIENT SUPPORT HAVING AN ADJUSTABLE POPLITEAL LENGTH, filed Jul. 30, 2004 and corresponding U.S. patent application Ser. No. 11/194,347, filed Aug. 1, 2005; and U.S. Application Ser. No. 60/592,613, entitled "ADVANCED ARTICULATION SYSTEM AND MATTRESS SUPPORT FOR A BED" filed Jul. 30, 2004 and corresponding U.S. patent application Ser. No. 11/192,698, filed Jul. 29, 2005, which are all expressly incorporated herein by reference.

BACKGROUND AND SUMMARY OF THE INVENTION

The present invention relates to a bed for supporting a patient, including a hospital bed. More particularly, the present invention relates to a bed having siderails and an articulating deck to support a mattress.

Hospital bed and other patient supports are known. Typically, such patient supports are used to provide a support surface for patients or other individuals for treatment, recuperation, or rest. Many such patient supports include a frame, a deck supported by the frame, a mattress, siderails configured to block egress of a patient from the mattress, and a controller configured to control one or more features of the bed.

According to one embodiment of the present invention, there is provided a bed for supporting a patient. The bed includes a frame, head and foot supports coupled to the frame, and a deck coupled to the frame and disposed thereabove. The deck is longitudinally movable from a first position to a second position toward the foot of the bed. The deck includes a lowerable foot deck section initially disposed substantially above and between the head and foot supports when the deck is in the first position and substantially outside the head and foot supports when the deck is in the second position.

In accordance with another aspect of the present invention, there is provided a bed for supporting a patient including a frame, head and foot supports coupled to the frame, and a deck coupled to the frame and disposed thereabove with the deck including a lowerable foot deck section. The bed includes means for moving the deck relative to the frame from a first position to a second position towards the foot of the bed so that the lowerable foot deck section moves from a first generally horizontal position to a second generally vertical position.

A further aspect of the present invention includes a method of elevating a patient supported by a bed deck having back deck and foot deck portions from a horizontal position to a chair position. The method includes moving the bed deck longitudinally from a position disposed substantially between head and foot supports toward a foot portion of the bed until the patient's legs are disposed distally of the foot support of the bed, raising the back deck portion of the bed deck from a substantially horizontal position to an elevated position, and lowering the foot portion of the deck to a substantially vertical position adjacent to and outside the foot support of the bed.

Pursuant to another aspect of the present invention there is provided a method of moving a foot support section of a deck of a hospital bed from a generally horizontal position to a generally vertical position. The method includes moving the deck relative to a frame of the bed toward a foot end of the bed and permitting the foot deck section to move due to gravity from the generally horizontal position to the generally vertical position as the foot deck section moves past a foot end of a frame.

BRIEF DESCRIPTION OF THE DRAWINGS

The detailed description particularly refers to the accompanying figures, and in which.

DETAILED DESCRIPTION OF THE DRAWINGS

Figure 1:
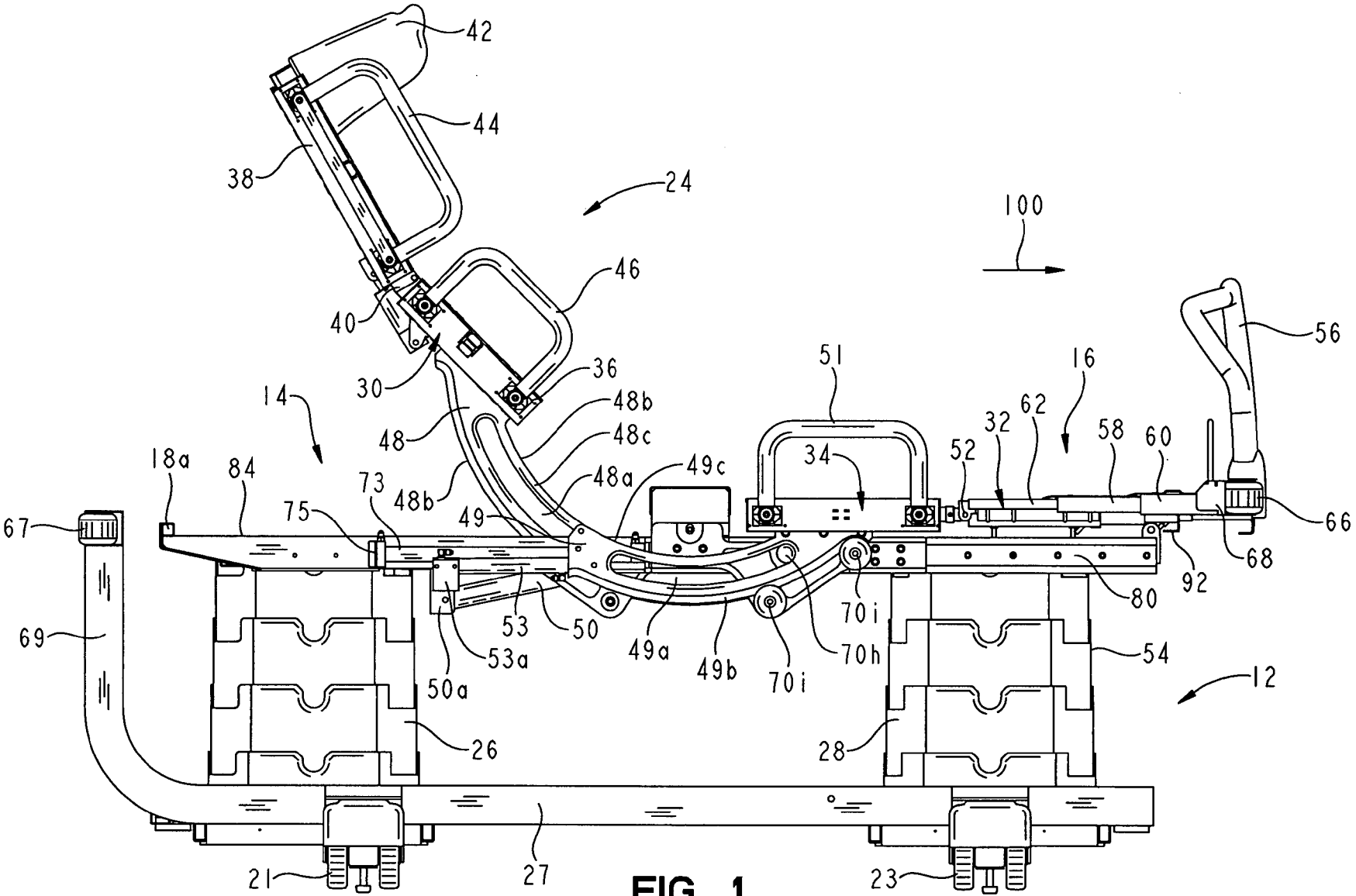
FIG. 1 is a side view of a first embodiment of the present invention illustrating the raising of the elevatable back section.
Figure 2:
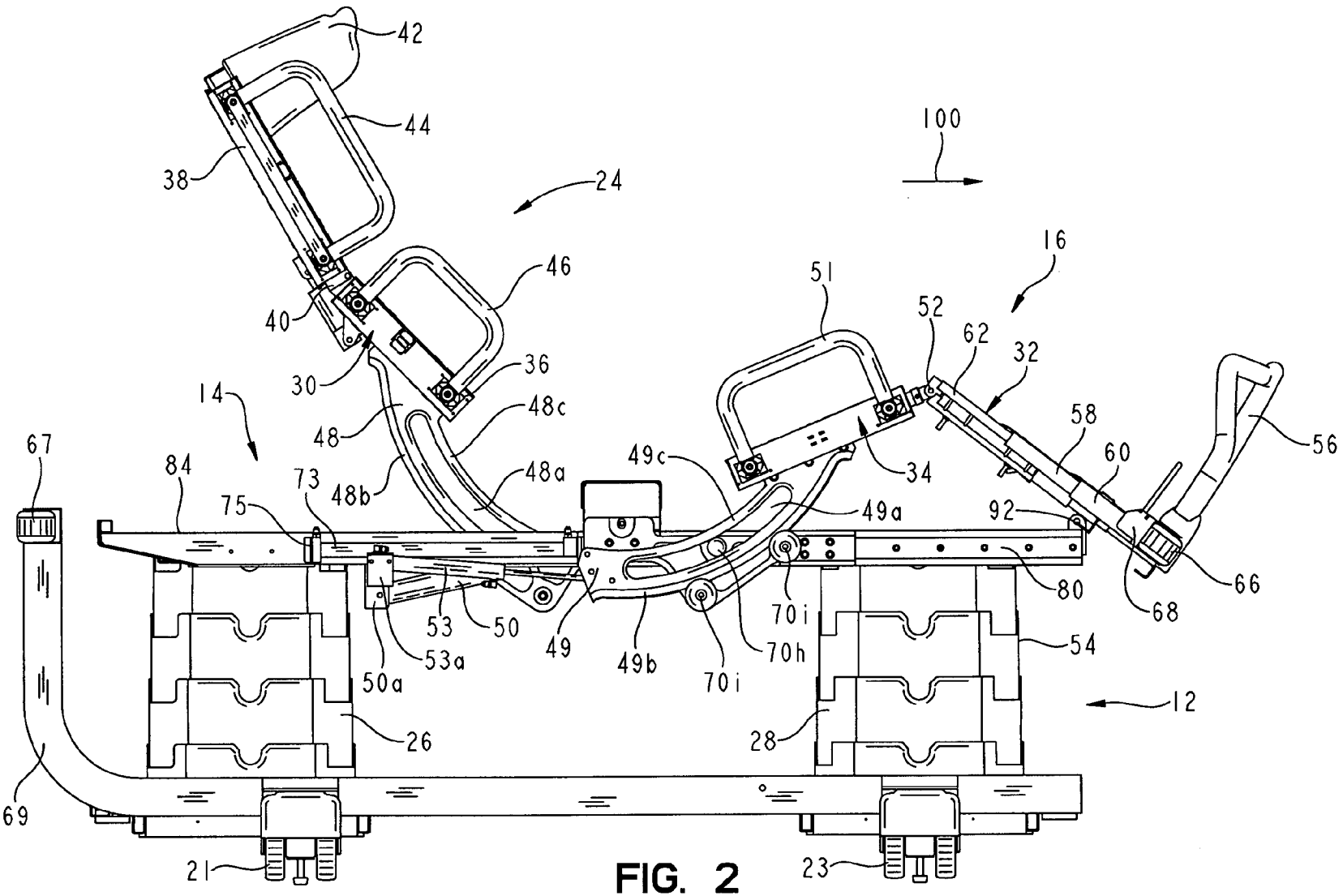
FIG. 2 is a side view of the bed of FIG. 1, illustrating the articulated thigh deck section in raised position for elevating the knees of the patient.
Figure 3:
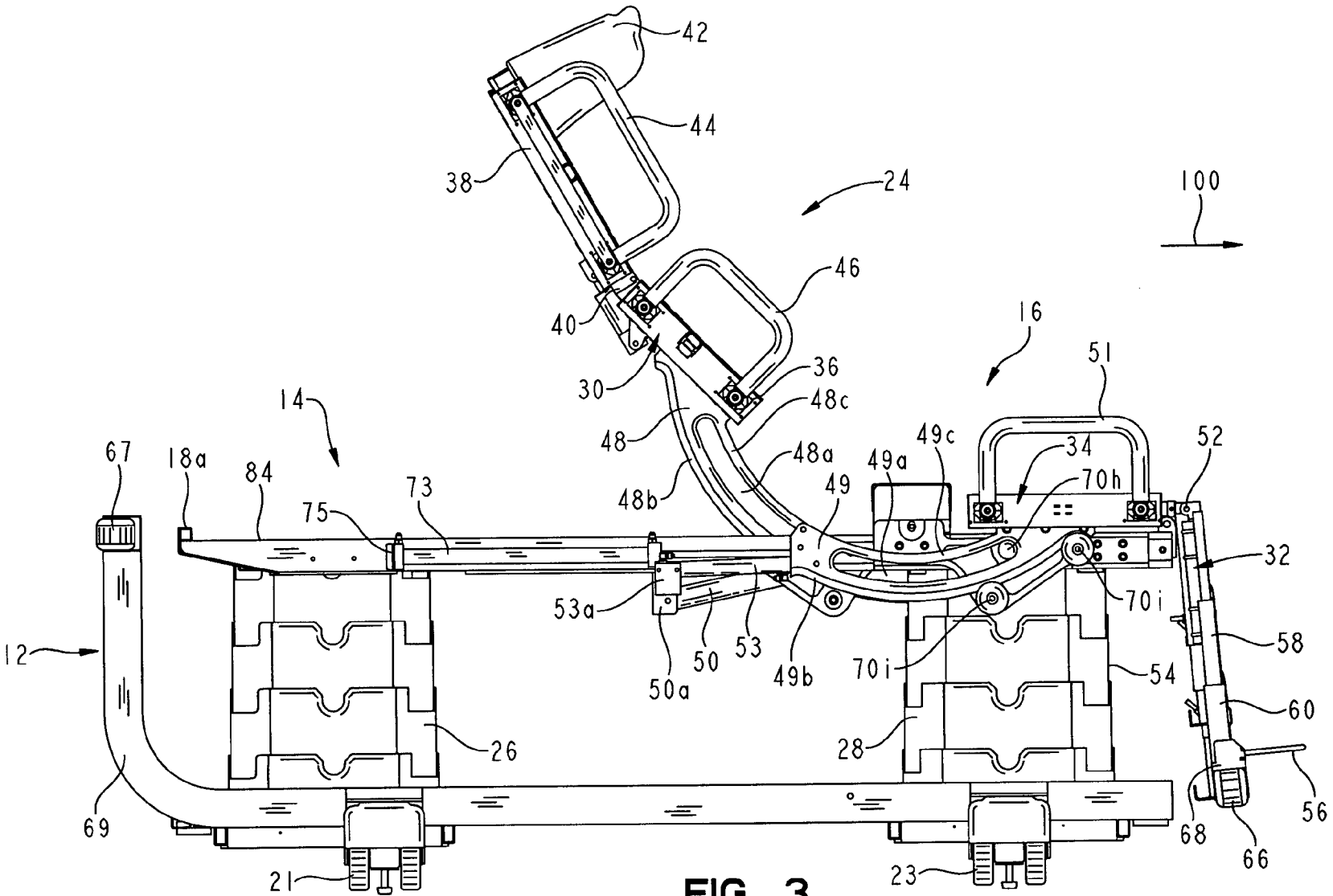
FIG. 3 is a side view of the bed of FIG. 1, illustrating movement of the deck section towards the foot of the bed, and lowering of the foot section to a position adjacent the outside surface of the foot support of the bed.

Referring now to the drawings, FIGS. 1-3 illustrate a first embodiment of the present invention. A bed 12 is illustrated for supporting a patient. The bed 12 has head and foot portions 14, 16.

Figure 4:
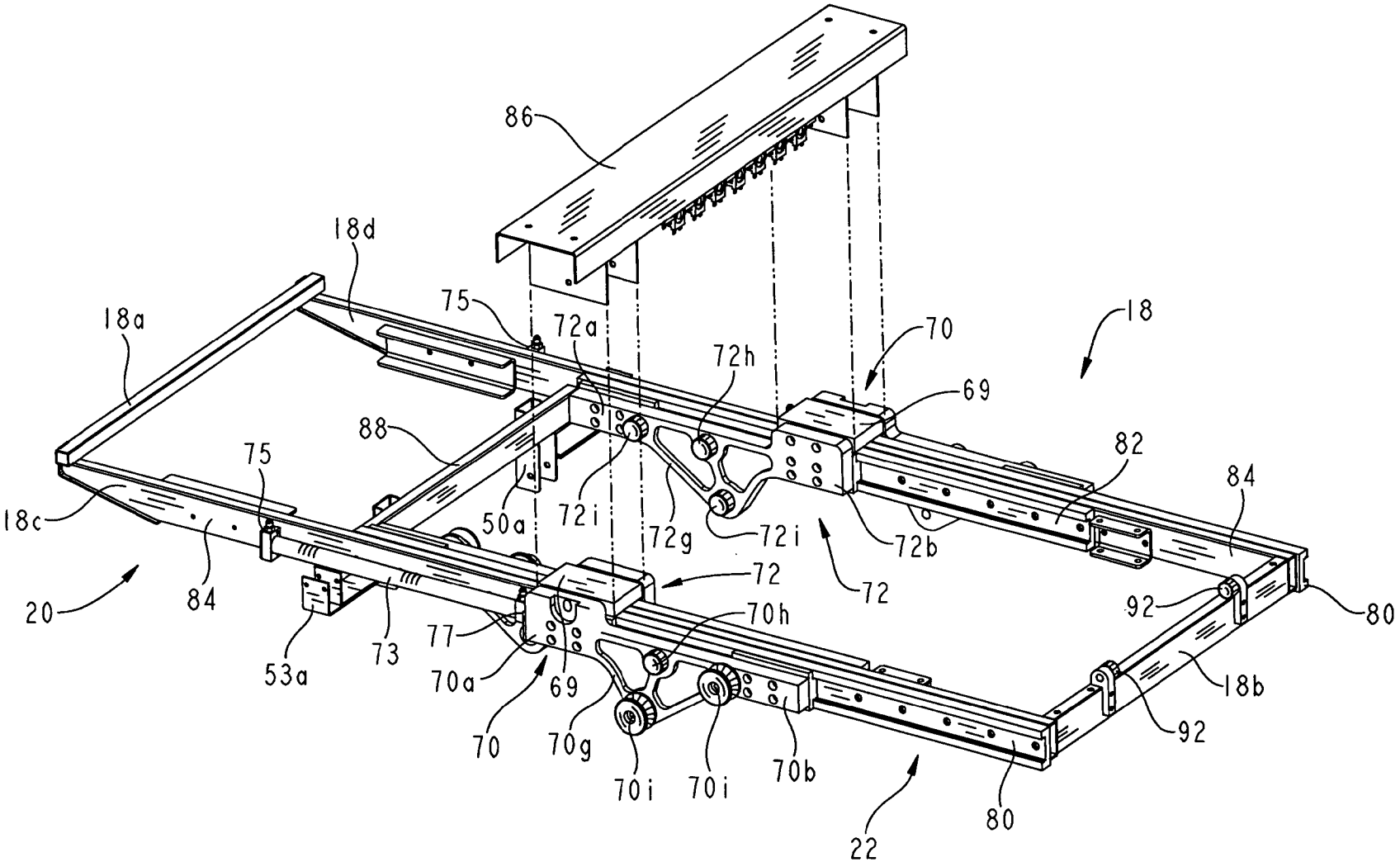
FIG. 4 is a perspective view of the bed frame of the bed of FIG. 1 illustrating details of the bed frame upon which are mounted support brackets, each carrying first and second cam guide assemblies, and illustrating the longitudinally slidable feature of the bed deck.
Figure 5:
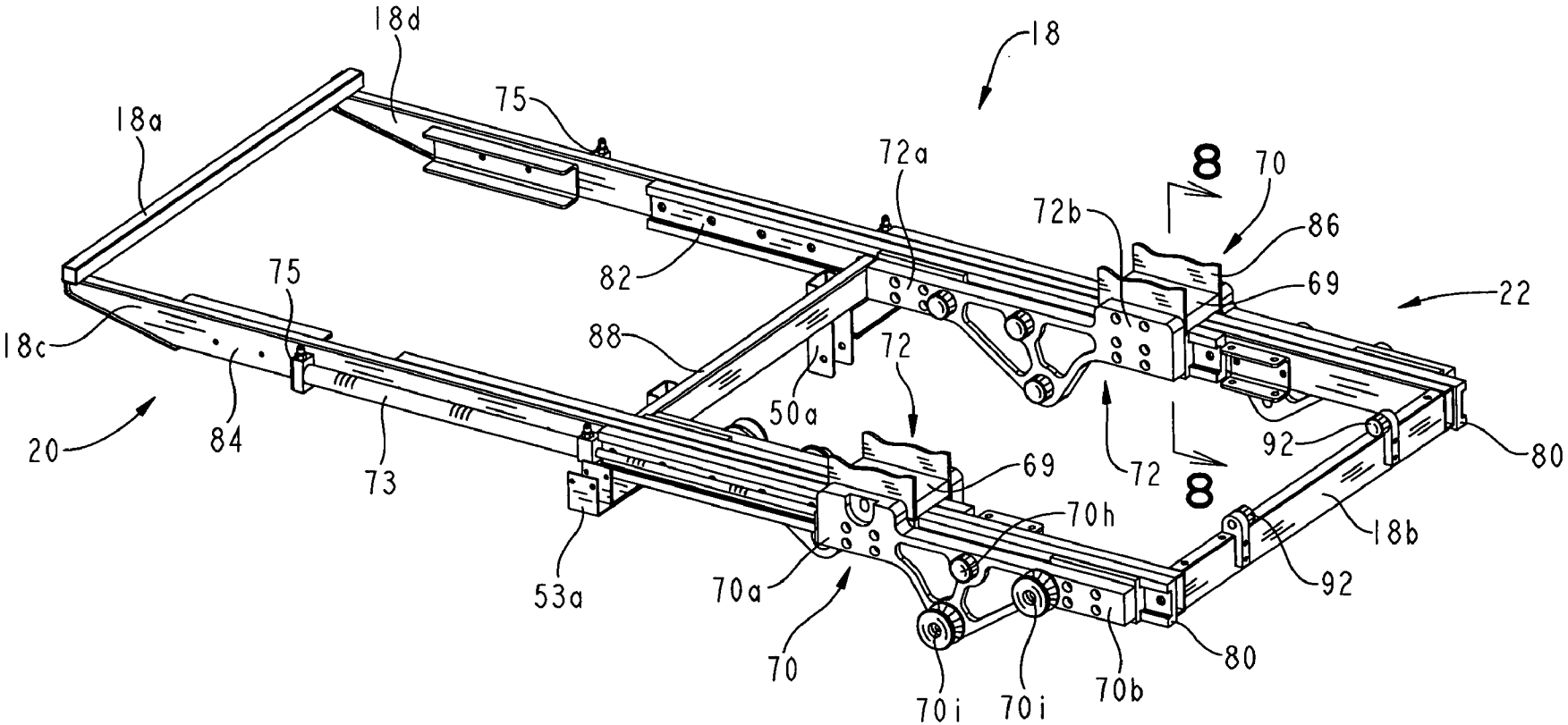
FIG. 5 is a perspective view of the bed frame of FIG. 4, illustrating the cam guide assemblies disposed in a position near the foot of the bed, which positioning functions for placing the patient into the sitting position.
Figure 6:
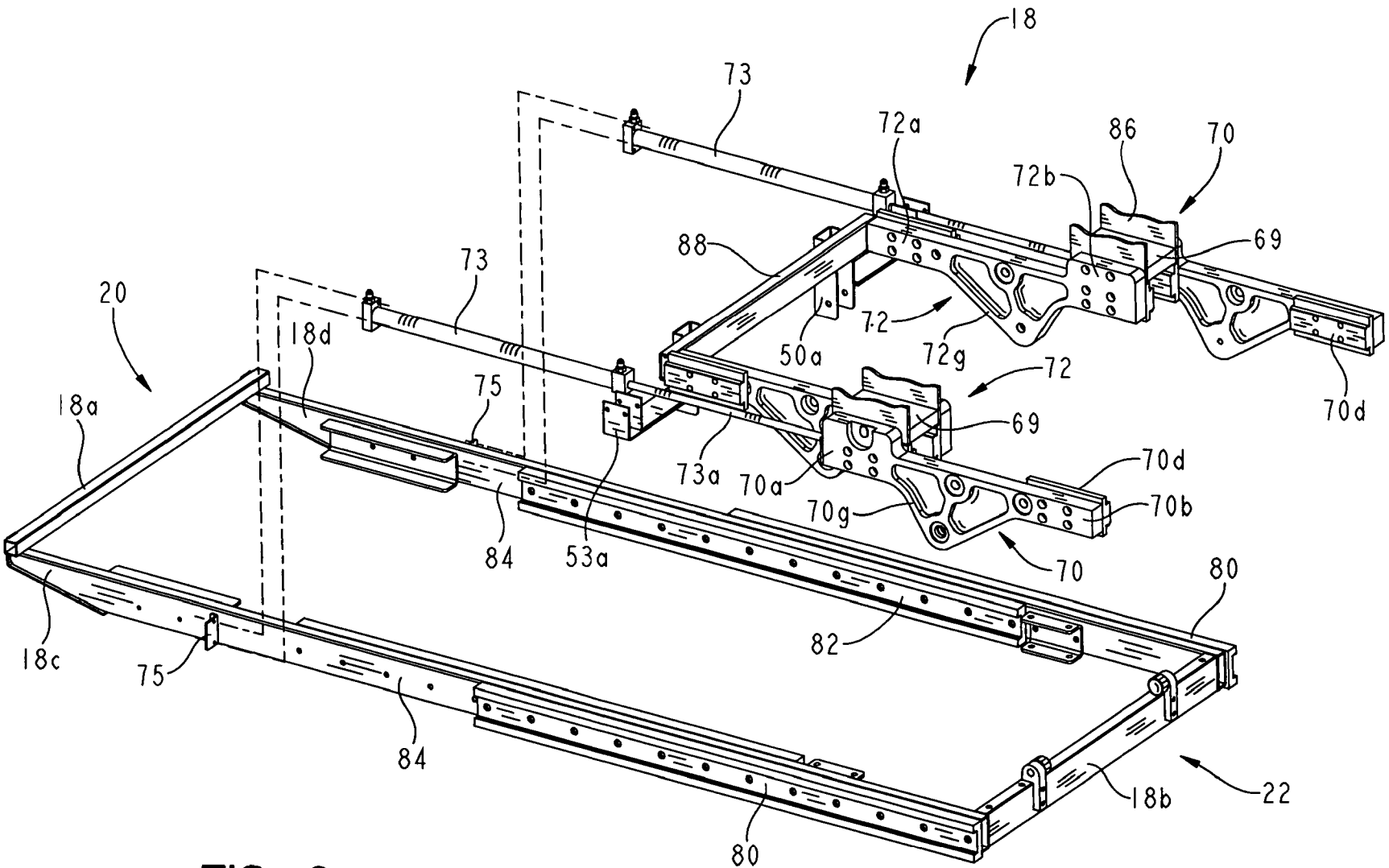
FIG. 6 is an exploded perspective view of the bed frame of FIGS. 4 and 5, and illustratively showing the cam guide assemblies in exploded view above the frame, in order to illustrate more clearly the mounting mechanism thereof.

Bed 12 further includes a frame 18, as shown in FIGS. 4-6, for example. Frame 18 likewise includes head and foot portions 20, 22, and comprises head, foot, and side frame members 18*a*, 18*b*, 18*c*, and 18*d*, for bearing the weight of the patient. A deck 24 is coupled to frame 18 and is disposed thereabove. The deck 24 is longitudinally movable from a first position, located generally between the head and foot supports 26, 28 of bed 12 (as shown in FIGS. 1-3) to a second position towards foot portion 22 of bed 12. Foot and head supports 26, 28 are in turn supported upon a base frame 27 supported by respective casters 21, 23. This movement of bed deck 24 is illustrated in FIGS. 1-3. Deck 24 includes an elevatable back section generally 30, a lowerable foot section generally 32, and a thigh deck section generally 34 disposed intermediate the back deck section 30 and the foot deck section 32.

The elevatable back deck section 30 includes a proximally disposed lower back section 36 and a distally disposed head support section 38 connected by hinges 40 thereto. The head support section 38 includes a head rest 42 and a head mattress retention member 44, and the lower back section 36 includes a similar lower back section mattress retention member 46.

The elevatable back section 30, as shown in FIGS. 1-3, is connected to back section arcuate cam member 48 at lower back section 36 for raising and lowering elevatable back section 30 by means of a pair of back section pneumatic cylinders 50 connected to frame 18 by means of cylinder brackets 50*a*, one of which is visible in side elevational perspective beneath frame 18 in FIGS. 1-3. Additionally, FIGS. 1-3 illustrate thigh section pneumatic cylinder 53 connected to frame 18 at thigh section pneumatic cylinder bracket 53*a*, which bracket 53*a* is also shown in FIGS. 4-7.

The thigh deck section 34 is also articulately attached to the back section 30 by hinges (not shown) and also to foot deck section 32 at hinges 52, which is best shown in FIG. 2, wherein the thigh deck section 34 has been elevated. Thigh deck section 34 includes a thigh deck mattress retention member 51. In these and other preferred embodiments, the thigh deck section 34 is attached to a thigh deck section arcuate cam 49 for raising and lowering the thigh deck section 34. Additional details of the articulation of back deck section 30 and thigh deck Section 34 are illustrated in Application Ser. No. 60/592,613, entitled "ADVANCED ARTICULATION SYSTEM AND MATTRESS SUPPORT FOR A BED" filed Jul. 30, 2004 and corresponding U.S. patent application Ser. No. 11/192,698 filed Jul. 29, 2005, which is expressly incorporated by reference.

As shown in FIG. 1, the foot deck section 32 is initially in a first position above and generally located inside the load carrying capacity of the foot and head supports 26, 28. However, in FIG. 3, the foot deck section 32 has been lowered to a second position which is adjacent to outside surface 54 of the foot support 28, upon sliding of the entire deck 24 toward the foot section 16 of bed 12.

Figure 9:
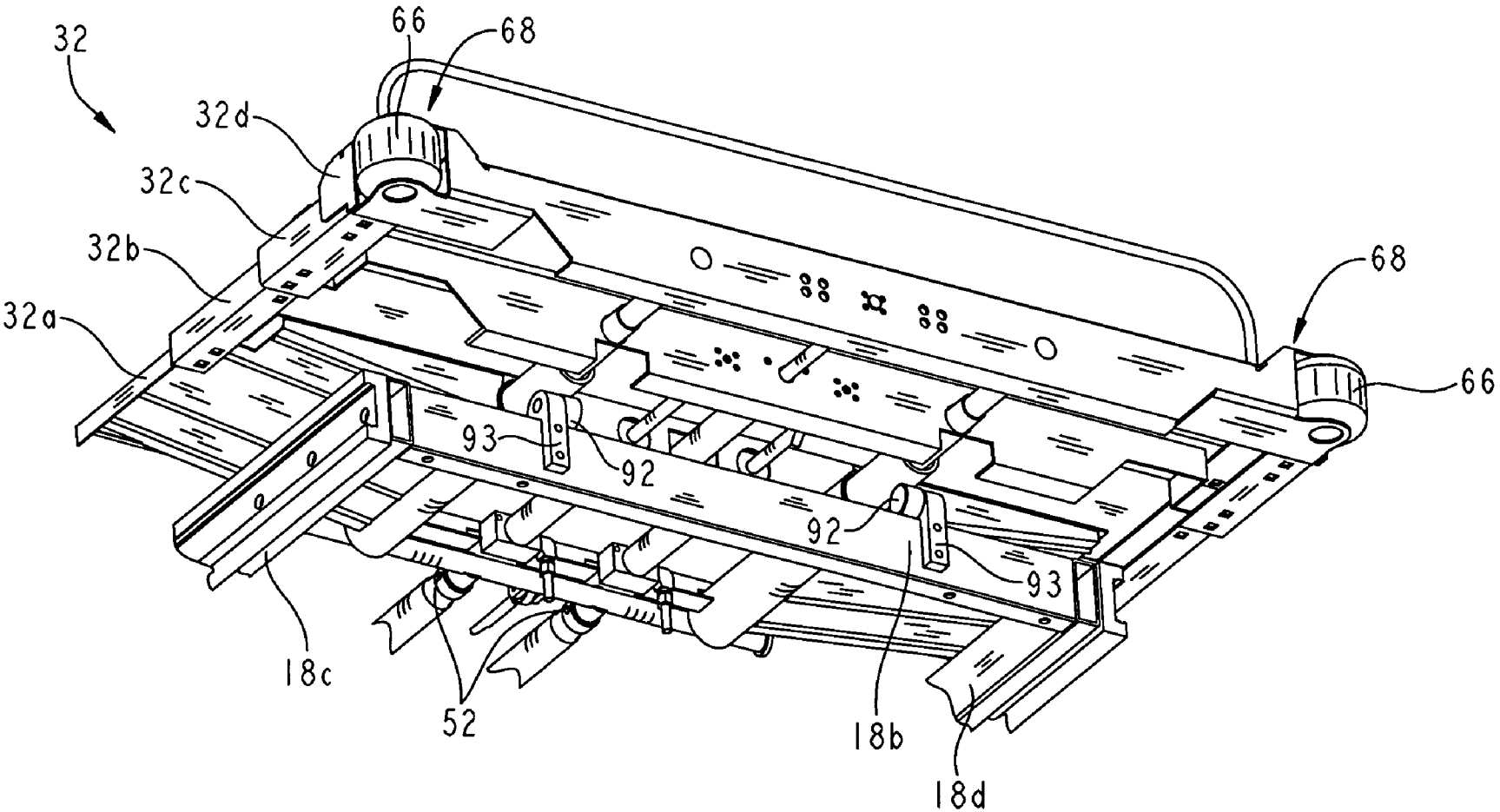
FIG. 9 is a fragmented, perspective view of the foot section of the bed deck illustrating the undercarriage thereof, including illustrations of the telescoping frame sections driven by respective pneumatic cylinders for shortening the foot deck section.

As also can be seen in FIG. 9, the lowerable foot deck section 32 includes upper and lower segments 32*a*, 32*b*, 32*c*, 32*d*, and which are extendable and retractable to lengthen and shorten the foot deck section 32 selectively. Details of extendable and retractable foot deck section 32 are disclosed in U.S. Application Ser. No. 60/591,838, entitled "HOSPITAL BED" filed on Jul. 28, 2004 and corresponding U.S. patent application Ser. No. 11/191,651 filed Jul. 28, 2005, which is expressly incorporated herein by reference.

Foot deck section 32 is also equipped with rollers 66 on the lateral corners 68 which act as bumpers. Similarly, rollers 67 may be provided at push handle 69 of bed 12. Foot and head supports 26, 28 are telescopable downwardly for lowering the height of frame 18, and accordingly the patient, to assist in removing the patient from the hospital bed, once the hospital bed has been placed into a sitting position, such as shown in FIG. 3.

As best shown in FIGS. 4-8, the hospital bed 12 of the present invention further comprises a pair of outer cam guide assemblies 70 and a pair of inner cam guide assemblies 72. On each lateral side of frame 18, an outer cam guide assembly 70 is joined to an inner cam guide assembly by top plate 69 and bolts 69*a*, as shown. Each of outer cam guide assemblies 70 includes front and rear support plates 70*a*, 70*b*. Each of inner cam guide assemblies 72 similarly includes front and rear support plates 72*a*, 72*b*. Respective plates 70*c*, 70*d* are disposed inwardly of front and rear support plates 72*a*, 72*b*, respectively, and include bearing surfaces 70*e*, 70*f*, respectively. Correspondingly, respective plates 72*c*, 72*d* are disposed inwardly of front and rear support plates 72*a*, 72*b*, respectively, and include bearing surfaces 72*e*, 72*f*, respectively.

As best shown in FIGS. 4-8, bearing surfaces 70*e*, 70*f* of outer cam guide assemblies 70, 70 ride within outer frame tracks or guide rails 80. Likewise, bearing surfaces 72*e*, 72*f* of inner cam guide assemblies 72, 72 ride within inner frame guide tracks or rails 82, which are joined together by means of a central frame beam 84 that is laterally positioned on the frame 18.

In the embodiment of FIG. 4 (and shown in FIGS. 5-8), a cross beam support 86 is attached to the respective tops of the cam guide assemblies 70, 72 for providing lateral stability. Additionally, a cross frame member 88 is attached to the front portion of the outer and inner cam guide assemblies 70, 72 likewise to provide additional lateral stability to the front of the cam guide assembly system.

Outer cam guide assemblies 70, further include cam guide brackets 70*g*, disposed between front and rear support plates 70*a*, 70*b*. Likewise, cam guide assemblies 72, further include cam guide brackets 72*g*, disposed between front and rear support plates 72*a*, 72*b*.

Figure 7:
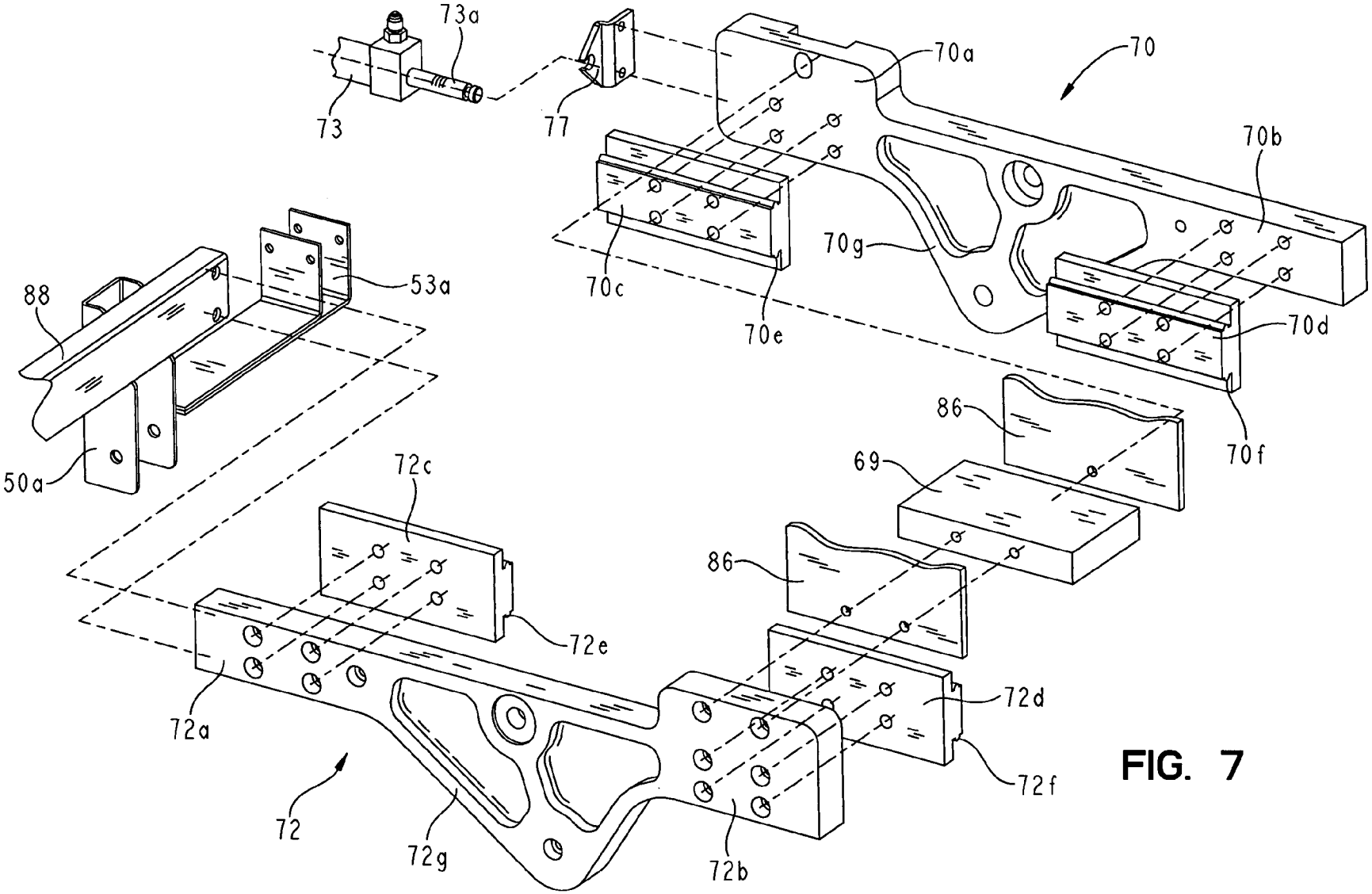
FIG. 7 is an enlarged perspective exploded view of the details of the support bracket system, showing an outer disposed cam guide assembly (at the top) and an inner disposed cam guide assembly (at the bottom)
Figure 8:
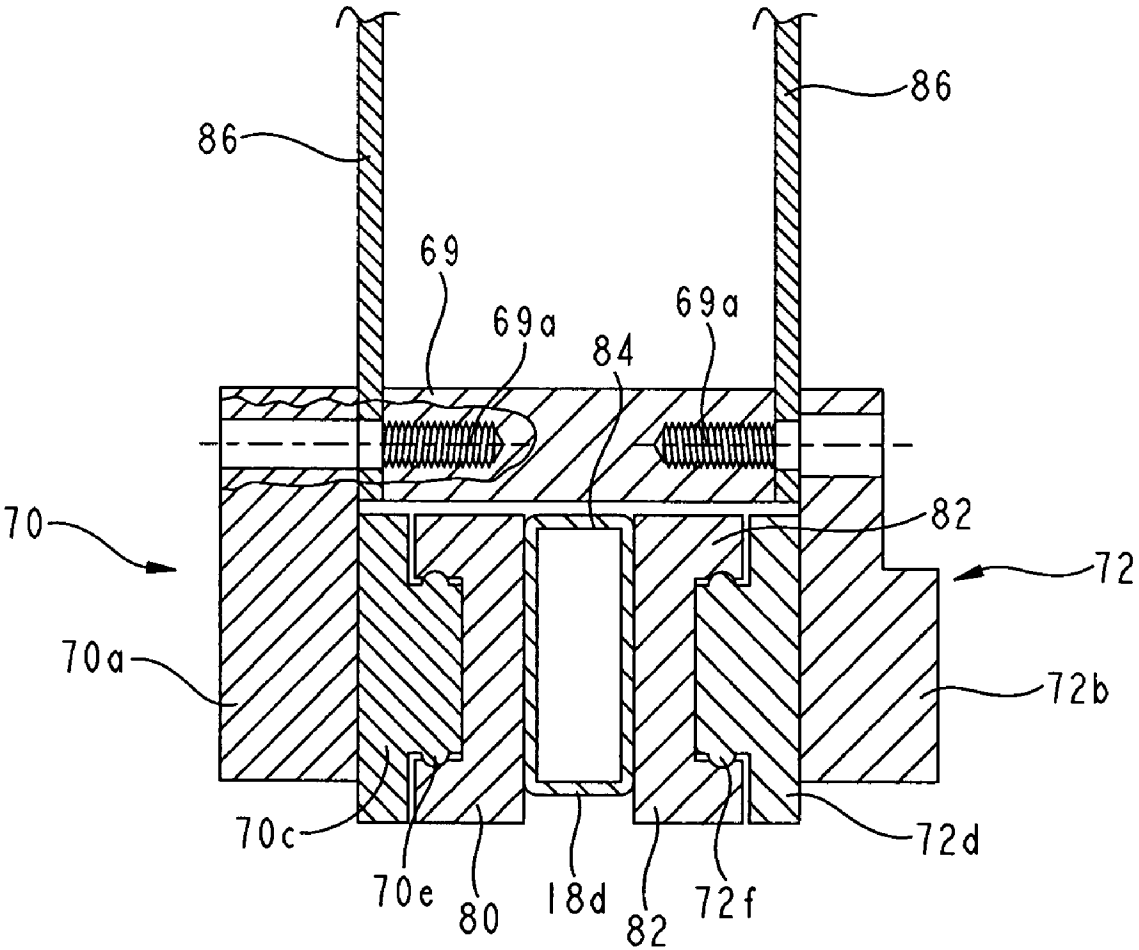
FIG. 8 is a greatly enlarged cross-sectional view taken along lines 8-8 of FIG. 5, and showing the cam guide assembly interior and outer plates, including inwardly disposed roller bearings mounted within respective guide rails of the bed frame.

Cam guide assemblies 70, 72 are driven collectively toward foot portion 16 of bed 18 and retracted towards head portion 14 of bed 18 by means of deck driving cylinders 73 having extendable and retractable rods 73*a*. Deck driving cylinders 73 are attached to frame 18 by means of cylinder brackets 75 and to cam guide assemblies 70, 72 by means of deck cylinder bracket 77, as shown in FIG. 7, for example.

In alternative embodiments, a further cross bar (not shown) may be attached to the brackets shown in FIG. 4 for increasing the lateral stability of the foot portion of the cam guide apparatus, and thus, to form box-like slidable sub-frame including cam guide assemblies 70, 72 that slides within frame 18 and outside of frame 18, as shown in FIGS. 4 and 5.

As described herein and as shown in FIGS. 4 and 5, preferred embodiments of the cam guide assemblies 70, 72 include supports 70*g*, 72*g* upon which are disposed respective cam followers 70*h*, 72*h* and cam support rollers 70*i*, 72*i*. FIG. 4 shows cam guide assemblies 70, 72, for example, with the outside cam guide assembly 70 for raising and lowering the thigh deck section 34, and an inside cam guide assembly 72 for raising and lowering the back deck. Further details are in Application Ser. No. 60/592,613 entitled "ADVANCED ARTICULATION SYSTEM AND MATTRES SUPPORT FOR A BED" filed Jul. 30, 2004 and corresponding U.S. patent application Ser. No. 11/192,698 filed Jul. 29, 2005, which is expressly incorporated by reference.

In illustrated embodiments, the cam followers 70*h*, 72*h* and the pair of cam support rollers 70*i*, 72*i* for each cam deck assembly are disposed in a triangular-shaped array, as shown in FIGS. 4-7. The back section arcuate cam 48 and the thigh section arcuate cam 49 each comprise cam follower slots, respectively 48*a*, 49*a*, for containing the respective cam followers 72*h*, 70*h*.

As shown in FIGS. 1-3, cylinders 50 are attached to back deck section 30 for elevating and lowering the back deck section 30. Also, cylinders 53 are attached to the articulated thigh deck section 34 for elevating and lowering the articulated thigh deck section 34.

The improved hospital bed structure 12, as shown in FIGS. 1-8, is utilized to move a patient from a horizontal position (not shown) to a chair position by moving the patient supported by deck 24 longitudinally from a position disposed between the head and foot supports 26, 28 towards the foot portion 16 of bed 12. This longitudinal movement of deck 24 continues until the patient's legs are disposed distally of foot support 28 of bed 12. The head and back of the patient are raised to an elevated position, also as shown in FIGS. 1, 2 and 3, and as described above. Finally, the patient's lower leg portions are lowered to a substantially vertical position adjacent to and outside foot section 16 of bed 12, as best illustrated in FIG. 3, wherein foot deck section 32 has been lowered.

The lowering of the foot deck section 24 is accomplished by gravity-operated means and a pair of rollers 92 which are illustratively coupled to frame member 186 of frame 18 by brackets 93 for facilitating the gravity-operated lowering of foot deck section 32. Additionally, the improved hospital bed 12 of the present invention may be utilized for raising the knees of the patient, as shown in FIG. 2, by means of cylinders operating the thigh arcuate shaped cam assemblies 49 which are journaled upon cam followers 70*h*, as shown in FIGS. 4 and 5.

Figure 10:
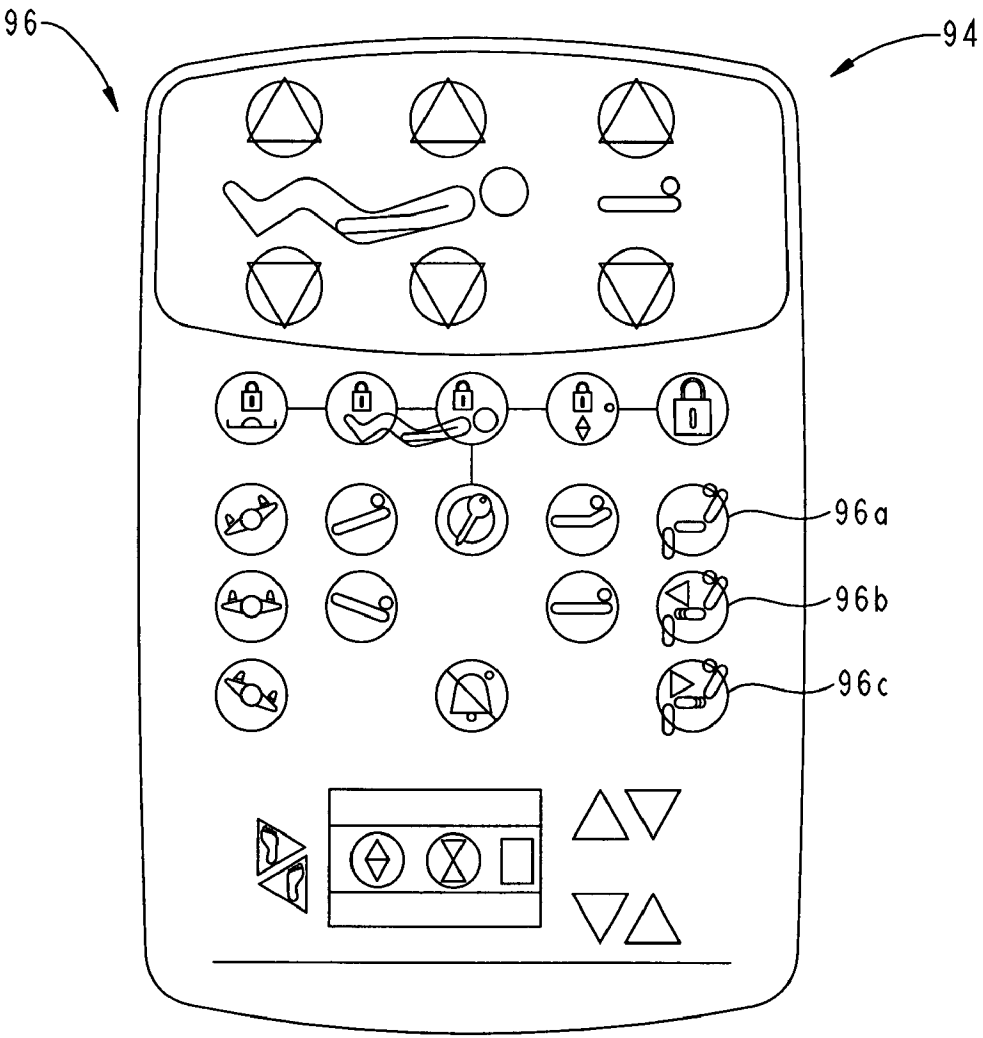
FIG. 10 is a schematic drawing of a control panel for the hospital bed.

FIG. 10 is a schematic view of one form of a control device generally 94 for operating the bed of the present invention, and includes a plurality of buttons generally 96 carried upon case 98 for the operation thereof. Wide variations in different forms of control devices are well within the capabilities of those skilled in the art. In illustrated embodiments, each of the buttons 96 may contain a self-explanatory icon for configuring the position of the patient within bed 12. Buttons 96*a*, 96*b* and 96*c* illustratively control movement of the deck toward and away from the foot end of bed 12 to move the deck to the chair position.

When a caregiver or user presses the appropriate buttons on control device 94 or other suitable controls on the siderail, pendant, or other suitable controller, the deck 24 moves toward foot end 16 of bed 12 from a first position shown in FIGS. 1 and 2 to a second position shown in FIG. 3. Foot section 32 rides over rollers 92 coupled to frame 18 as the deck moves in the direction of arrow 100 toward foot end 16. The sub-frame supporting the deck 24 moves generally from the position shown in FIG. 4 to the position shown in FIG. 5 as the deck is moved toward the foot end 16 of bed 12. Foot deck section 32 automatically moves from the generally horizontal position shown in FIG. 1 or from the angled knee gatch position shown in FIG. 16 downwardly toward the generally vertical position shown in FIG. 3 as the deck 24 moves toward the foot end 16. Movement of the deck section from the raised, generally horizontal position to the lowered, generally vertical position is not controlled by any type of powered actuator or linkage coupling the foot section to the remainder of the deck. The apparatus of the present invention uses movement of the deck and gravity to move the foot deck section between its first and second positions.

The configuration of spaced apart supports 26 and 28 combined with the sliding deck 24 is particularly useful for bariatric patients. An illustrated embodiment, the deck is generally centered between the first and second supports 26 and 28 when the deck is not in the chair position. The foot deck section 32 slides "over the edge" past foot support 28 when in the chair position. An alternative embodiment, the sliding deck could be used with a powered moveable foot section 32, if desired. In this embodiment, a suitable actuator, such as a cylinder or linear actuator or other linkage is used to control pivotable movement of the foot deck section 32 about pivot 52 relative to the remainder of the deck 24.

Although the invention has been described in detail with reference to certain illustrated embodiments, variations and modifications exist within the scope and spirit of the invention as described and as defined in the following claims.

What is claimed is:

1. A bed for supporting a patient, the bed comprising: a base, a frame; head and foot supports coupled to the frame; and a deck coupled to the frame and disposed thereabove, the deck being longitudinally movable from a first position to a second position toward the foot of the bed, the deck including a lowerable foot deck section initially disposed substantially above and between the head and foot supports when the deck is in the first position and substantially outside the head and foot supports when the deck is in the second position, the head support having a first end coupled to a first portion of the frame and a second end coupled to a first portion of the base, and the foot support having a first end coupled to a second portion of the frame and a second end coupled to a second portion of the base.

2. The bed of claim 1, wherein the deck also includes an elevatable back deck section having a lower back section and a head support section pivotably coupled thereto.

3. The bed of claim 1, wherein the elevatable back section is connected to a back deck section arcuate cam for raising and lowering the elevatable back section.

4. The bed of claim 1, wherein the deck includes an articulated thigh deck section which is elevatable.

5. The bed of claim 4, wherein the articulated thigh deck section is connected to a thigh deck section arcuate cam for raising and lowering the thigh deck section.

6. The bed of claim 1, wherein the foot section is disposed substantially adjacent the foot support when in the second position.

7. The bed of claim 1, wherein the foot section is hingedly connected to a thigh deck section.

8. The bed of claim 1, wherein the foot section is lowerable by gravity as the deck moves from the first position to the second position.

9. The bed of claim 1, wherein the foot section has an extendable and retractable length.

10. The bed of claim 1, wherein the foot section includes a telescoping track for shortening the length of the foot section.

11. The bed of claim 1, wherein the head and foot supports include a hi/lo mechanism to raise and lower the bed frame.

12. The bed of claim 1, further comprising an actuator attached to the deck for longitudinally moving the deck relative to the frame.

13. The bed of claim 1, wherein at least one of the first and second ends of the head support is positioned toward a head end of the bed, and at least one of the first and second ends of the foot support is positioned toward a foot end of the bed.

14. A bed for supporting a patient, the bed comprising: a base; a frame; head and foot supports each having a first end coupled to the base and a second end coupled to the frame; a deck coupled to the frame and disposed thereabove, the deck including a lowerable foot deck section; and means for longitudinally moving the deck relative to the frame from a first position substantially above and between the head and foot supports to a second position substantially outside the head and foot supports and towards the foot of the bed so that the lowerable foot deck section moves from a first generally horizontal position to a second generally vertical position, the means for moving including means for supporting a bariatric patient during movement of the deck.

15. The bed of claim 14, wherein the foot section is moved from the first position to the second position due to gravity.

16. The bed of claim 14, wherein the bed further comprises means for elevating and lowering a back deck section.

17. The bed of claim 14, wherein the bed further comprises means for elevating and lowering a thigh deck section.

18. The bed of claim 14, means for extending and retracting a length of the foot deck section.

19. The bed of claim 14, wherein the frame includes at least one longitudinal member, the longitudinal member has first and second laterally spaced sides, and the means for moving includes at least one cam guide assembly having a first portion of the cam guide assembly coupled to the first side of the longitudinal member and a second portion of the cam guide assembly coupled to the second side of the longitudinal member.

20. The bed of claim 14, wherein the means for supporting a bariatric patient includes a lateral stabilizer.

21. A method of elevating a patient supported by a bed deck having back deck and foot deck portions from a horizontal position to a chair position, the method comprising: moving the bed deck longitudinally from a position disposed substantially between spaced-apart, height-adjustable head and foot supports each having a first end coupled to a frame of the bed and a second end coupled to a base of the bed, wherein the frame supports the deck and is supported by the base, toward a foot portion of the bed until the patient's legs are disposed distally of the foot support of the bed; raising the back deck portion of the bed deck from a substantially horizontal position to an elevated position; and lowering the foot portion of the deck from a position substantially above and between the head and foot supports to a substantially vertical position outside the head and foot supports of the bed.

22. The method of claim 21, wherein the steps of moving the deck and raising the back deck portion are simultaneously carried out.

23. The method of claim 21, wherein the foot portion of the deck is lowered automatically due to gravity as the bed deck is moved toward the foot end of the bed.

24. The method of claim 21, wherein the head and foot supports are telescopable to adjust the height of the frame.

25. A method of moving a foot support section of a deck of a hospital bed from a generally horizontal position substantially above and between head and foot supports each having a first end coupled to a frame of the bed and a second end coupled to a base of the bed to a generally vertical position substantially outside the head and foot supports, wherein the frame supports the deck and is supported by the base, the method comprising: using a control device to actuate moving the deck relative to the frame of the bed toward a foot end of the bed; and permitting the foot deck section to move due to gravity from the generally horizontal position to the generally vertical position as the foot deck section moves past a foot end of a frame.

26. The method of claim 25, wherein the control device includes an icon indicative of the longitudinal deck movement function.

* * * * *